US006719810B1

(12) United States Patent
Kelly et al.

(10) Patent No.: US 6,719,810 B1
(45) Date of Patent: Apr. 13, 2004

(54) METHOD FOR PROVIDING PROTECTIVE TREATMENT TO NYLON FIBERS

(76) Inventors: David R. Kelly, 111 Savannah Way, Ft. Oglethorpe, GA (US) 30742; Randy J. Rawlston, 1606 Kamin Rd., Hixson, TN (US) 37343; Robert R. Hixson, 333 S. Mission Ridge Rd., Rossville, GA (US) 30741

( * ) Notice: Subject to any disclaimer, the term of this patent is extended or adjusted under 35 U.S.C. 154(b) by 0 days.

(21) Appl. No.: 10/436,042

(22) Filed: May 12, 2003

Related U.S. Application Data

(63) Continuation of application No. 09/804,807, filed on Mar. 13, 2001, now abandoned.
(60) Provisional application No. 60/189,397, filed on Mar. 15, 2000.

(51) Int. Cl.[7] ..... D06P 3/10
(52) U.S. Cl. ..... 8/115.6; 8/181; 8/127.6; 8/115.56; 8/115.58; 8/115.65; 8/539; 8/543
(58) Field of Search ..... 8/115.6, 181, 127.6, 8/115.54, 115.58, 115.65, 539, 543

(56) References Cited

U.S. PATENT DOCUMENTS

| | | | | |
|---|---|---|---|---|
| 4,067,689 A | | 1/1978 | Perrier et al. | 8/129 |
| 4,766,030 A | | 8/1988 | Hervey | 428/289 |
| 5,316,850 A | | 5/1994 | Sargent et al. | 428/378 |
| 5,445,653 A | | 8/1995 | Hixson et al. | 8/549 |
| 5,560,992 A | | 10/1996 | Sargent et al. | 428/373 |
| 5,573,553 A | | 11/1996 | McBride et al. | 8/115.56 |
| 5,672,651 A | | 9/1997 | Smith | 524/590 |
| 5,707,469 A | | 1/1998 | Hixson et al. | 156/72 |
| 5,725,789 A | | 3/1998 | Huber et al. | 252/8.62 |
| 5,759,431 A | | 6/1998 | Nguyen | 252/8.62 |
| 5,888,290 A | | 3/1999 | Engle et al. | 106/287 |
| 5,925,149 A | | 7/1999 | Pacifici et al. | 8/481 |
| 5,952,409 A | | 9/1999 | Boardman et al. | 524/185 |
| 5,972,046 A | * | 10/1999 | Hixson et al. | 8/539 |
| 5,998,306 A | | 12/1999 | Mura | 442/59 |

FOREIGN PATENT DOCUMENTS

| | | |
|---|---|---|
| JP | 61-201077 | 9/1986 |
| JP | 11-50379 | 2/1999 |
| WO | WO 092018332 A | 10/1992 |

* cited by examiner

*Primary Examiner*—Yogendra N. Gupta
*Assistant Examiner*—Eisa Elhilo
(74) *Attorney, Agent, or Firm*—Chambliss, Bahner & Stophel, P.C.

(57) ABSTRACT

The invention provides a method for reacting a variety of protective entities to form covalent bonds with nylon, which entities can be applied directly in the dyebath with the dyes that are used to dye the nylon without blocking such dyes or interfering with their color yield. Such protective entities include stain-blockers, chlorine resist agents, fire retardants, UV absorbers, antimicrobial agents, fume fade protectors, soil-resist agents and anti-stats. According to this method, a protective entity is reacted with a moiety having the capability of forming a covalent bond with a nylon fiber to create a modified protective entity that is adapted to form a covalent bond with a nylon fiber. The modified protective entity is added to a dyebath containing one or more dyes selected from the group consisting of fiber reactive dyes, acid dyes, acid-premetalized dyes and disperse dyes. The dyebath is applied to nylon fiber at a pH within the range of about 0.5 to about 6.5, and an alkali solution is then applied to the fiber.

8 Claims, No Drawings

METHOD FOR PROVIDING PROTECTIVE TREATMENT TO NYLON FIBERS

CROSS REFERENCE TO RELATED APPLICATIONS

This application is a continuation of U.S. patent application Ser. No. 09/804,807, entitled COVALENTLY BONDED PROTECTORS FOR NYLON FIBERS, YARNS AND FINISHED PRODUCTS, which was filed on Mar. 13, 2001 abandoned. This application also claims the benefit of U.S. Provisional Application No. 60/189,397, which was filed on Mar. 15, 2000, through the aformentioned parent application.

FIELD OF THE INVENTION

This invention relates generally to compositions and methods for protecting nylon fibers, yarns and finished products such as carpets from staining, discoloration or degradation, and more specifically to the application of a protective composition that is capable of forming a covalent bond with the nylon.

BACKGROUND AND DESCRIPTION OF THE PRIOR ART

Carpets constructed from continuous filament and spun nylon yarns have been a major factor in the carpet and floor covering industry for many years. Such carpets offer excellent wear and durability properties along with unlimited coloration and styling potential. The open structure of the nylon fibers makes them easy to dye with a wide variety of dyestuffs such as acid and acid-premetalized dyes, disperse dyes and fiber reactive dyes. Acid dyes are most commonly used in the industry and generally bond with the amine ends in the nylon by an ionic mechanism under acid pH conditions.

The excellent properties of nylon has led to its acceptance for other end uses such as rugs, walk-off mats, upholstery and automotive interiors. Indeed, the fiber has come to rival cotton as the most important fiber in the textile industry.

In spite of its excellent properties, nylon has certain deficiencies which has led to broad usage of competitive fibers such as polypropylene and polyester. While nylon is considered by many to be a hydrophobic fiber and has been described as such in industry literature, it actually is penetrated quite easily by aqueous solutions, almost as easily as cotton. This has created problems with the usage of nylon in the carpet and rug industry and has led to the usage of competitive hydrophobic fibers. One such problem is staining when common colored foods and household products are spilled on a nylon carpet. Artificial colors that are used in products like Kool-Aid and spaghetti sauce are anionic in nature, similar to the acid dyes used to dye the nylon. When these anionic spills are absorbed into the fiber, they will react with the dyesites and produce a permanent stain. Another problem is bleach spots when strong oxidizing agents such as chlorine bleach are spilled on the carpet or intentionally applied in an attempt to remove a stain. The color of the carpet will become lighter and may completely disappear where the bleach is absorbed into the nylon fiber.

Because they are more hydrophobic than nylon, polypropylene and polyester are more resistant to anionic stains and bleach, and a number of products have been developed for application to nylon in order to improve its stain and bleach resistance. Such products are known in the trade as stain blockers and bleach protectors. Such products are typically condensates of formaldehyde with phenolsulfonic or naphtholsulfonic acids, sulfonates of dihydroxydiphenyl sulfone or sulfonated aromatic aldehyde condensates. If they are intended to provide bleach protection, they will contain a group that will act as an antioxidant.

The two things that these products all have in common is that they are aromatic and contain one or more sulfonic acid groups. The sulfonic acid groups cause these conventional products to be anionic under acid pH conditions, which gives them the ability to ionically attach to the amine groups in the nylon. It is suspected that other types of weak bonding may also occur between these conventional stain blockers and bleach protectors and the nylon, such as hydrogen bonding, van der Waals forces and dipole attraction. Resistance to stain occurs because occupation of available amine ends (dyesites) by the anionic charged chemicals will electrostatically repel the similarly charged anionic stain colorants and keep them from bonding with the nylon.

These conventional products have been successfully used in the carpet and rug industries. However, they have one primary drawback. Nylon carpets, rugs and mats are designed to last for many years. Some companies guarantee their products for as long as 20 years. Since the type of bonding which occurs between these anionic stainblockers and bleach protectors and nylon is relatively weak, there is a high probability that the bonds of these conventional protective products with nylon will be broken so that the products will lose some or all of their effectiveness over the anticipated useful life of a carpet product. In the case of carpets, this could occur through repeated steam cleanings and wear in high traffic areas. Rugs are periodically washed and/or dry-cleaned. Mats regularly undergo high temperature laundering. It would be desirable, therefore, if a better-performing stainblocker and bleach protector, that will last for the anticipated lifetime of a carpet product, could be developed. In U.S. Pat. No. 5,998,306, Mura describes technology for producing a series of UV absorbers which have stain-blocker properties based on a specific heterocyclic structure. Such products are said to covalently bond with textile materials but they also act as resist agents for anionic dyes. A process for synthesizing a variety of covalently bonded stain resist products is also described in U.S. Pat. No. 5,316,850 of Sargent and Williams. However, the application procedures of this patent require a two step method by which the chemicals are added separately from and on top of the dyestuffs.

ADVANTAGES OF THE INVENTION

It is well known in the textile industry that fiber reactive dyes which bond covalently with fibers afford the best wet-fastness which can be obtained. Fiber reactive dyes have not gained wide acceptance for use on nylon, however, because of the ease of application, variety of colors and familiarity of acid dyes. However, American Hoechst has described a procedure for applying fiber reactive dyes to unmodified nylons at a pH above 2.5. Hixson et.al. in U.S. Pat. Nos. 5,445,653 and 5,972,046 describe methods for applying fiber reactive dyes to cationic and light dyeable nylon fibers at pH of 1.5 or below by space dye, continuous dye and batch dye methods. In a practice of the procedures described in the Hixson patents, the dyes exhaust uniformly on the nylon in spite of the ultra-low pH conditions at which they are applied, and after formation of covalent bonds with the fiber, can withstand further wet processing at 210° F. The inventors have discovered that certain aromatic chemicals that function as colorfastness guards or nylon protectors may be modified to allow them to form covalent bonds with nylon fibers when applied simultaneously with the dyes in a dyebath. Such covalently bonded protective entities will exhibit excellent durability and longevity in spite of frequent and repeated washings or cleanings of the fibers. In addition, these protective entities, when applied simultaneously with the dyes in a dyebath, will assist in the level dye application of acid dyes and fiber reactive dyes to nylon fibers.

Additional advantages of this invention will become apparent from an examination of the ensuing description.

EXPLANATION OF TECHNICAL TERMS

As used herein, the term fiber includes filaments and fibers of all lengths and diameters, and fibers that have been formed into yarns, woven into fabrics, tufted or fusion bonded into carpets or formed into nonwoven fabrics, such as needlepunch fabrics or spunbonded or meltblown webs.

As used herein, the term fiber reactive dye refers to a type of water-soluble anionic dye that is capable of forming a covalent bond with nylon or cellulose fibers.

As used herein, the term protective entity refers to a chemical entity that may be used to protect fibers, such as (but not limited to) stain-blockers, chlorine resist agents and anti-oxidants, fire retardants and flammability protectors, ultraviolet radiation absorbers and other lightfastness protectors, antimicrobial and anti-bacterial agents, gas/fume fade protectors, mildew protectors, soil resist agents and antistats.

As used herein, the term modified protective entity refers to a protective entity that has been modified according to the invention so as to render it capable of forming a covalent bond with nylon.

SUMMARY OF THE INVENTION

The invention provides a variety of protective entities which will react to form covalent bonds with nylon and which can be applied directly in the dyebath with the dyes that are used to dye the nylon without blocking such dyes or interfering with their color yield. Such protective entities include stain-blockers, chlorine resist agents, fire retardants, UV absorbers, antimicrobial agents, fume fade protectors, soil-resist agents and anti-stats. According to this method, a protective entity is reacted with a moiety having the capability of forming a covalent bond with a nylon fiber to create a modified protective entity that is adapted to form a covalent bond with a nylon fiber. The modified protective entity is added to a dyebath containing one or more dyes selected from the group consisting of fiber reactive dyes, acid dyes, acid-premetalized dyes and disperse dyes. The dyebath is applied to nylon fiber at a pH within the range of about 0.5 to about 6.5, and an alkali solution is then applied to the fiber.

In order -to facilitate an understanding of the invention, a detailed description of the presently preferred embodiments of the invention is provided herein. It is not intended, however, that the invention be limited to the particular embodiments described or to use in connection with the dyeing procedures described herein. Various modifications and alternative embodiments such as would ordinarily occur to one skilled in the art to which the invention relates are also contemplated and included within the scope of the invention described and claimed herein.

DESCRIPTION OF THE PREFERRED EMBODIMENT OF THE INVENTION

While the most common protective entities that may be modified according to the invention are classified as stainblockers, resist agents and anti-oxidant chlorine protectors, other aromatic products which are used as ultraviolet radiation absorbers (lightfastness protectors), gas/fume fade protectors, mildew protectors, flammability protectors, anti-bacterial agents and other types of protectors are also susceptible to modification (and in such modified form, application) according to the invention, thus affording virtually unlimited durability to such protective entities as well.

It is also intended that the invention may be applied to both type 66 and type 6 nylons, regardless of the number of amine ends or carboxyl groups present in the nylon. By varying the pH at which the dyebath (with modified protective entity) is applied, the invention may be employed to treat fibers of deep dye, regular or medium dye, light dye and cationic dyeable nylon.

According to the invention, a protective entity is reacted with a chemical capable of forming a reactive group that will form covalent bonds with nylon fiber. Such a reaction would have a general formula such as:

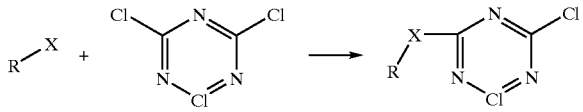

where R=any aromatic protective entity, and X=a hydroxyl or amino group capable of forming a covalently bonded bridge with a reactive group.

In the general formula shown above, the protective entity is reacted with trichloro-1,3,5-triazine. The protective entity may also be reacted with dichlorotriazines or monochlorotriazines. All of these are compounds in which the chlorines will readily react with carboxyl or amino groups on the aromatic protective entity through nucleophilic substitution reactions.

Another type of reaction could be established between a protective entity and a vinyl sulfone, such as sulfato-ethyl sulfone or a vinyl sulfone ester such as acetimydophenylhydroxyethylsulfone sulfuric acid ester (also known as para-ester):

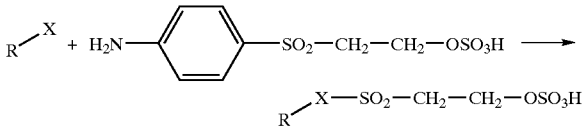

where R and X have the meanings described above.

Vinyl sulfone and chlorotriazine type reactive groups are selected as preferred types because research has shown that only fiber reactive dyes of these types will react in a substantial way with nylon fibers under acidic pH conditions. Since a preferred embodiment of the invention contemplates that the modified protective entity will be applied to the fiber as a part of a dyebath containing fiber reactive dyes, in order to insure compatibility with the dyes in the bath, it is necessary for the reactive groups on the protective chemicals to be the same as or compatible with the reactive groups on the dyestuffs being applied. It is also contemplated that the fiber reactive dye may be bifunctional, in that it may contain two of the reactive groups, and in such case, it is preferred that the protective entity be modified by the addition of a reactive group that is the same as or is compatible with one of the reactive groups on the dye. However, the invention is not restricted to use of vinyl sulfone and chlorotriazine type reactive molecules as reactive groups. Other types of reactive groups that can be reacted with protective entities, as determined by reasonable experimentation, may also prove useful.

If the fiber reactive (or modified) protective entity is being applied to nylon along with one or more fiber reactive dyes, it may be previnylized, if desired, in the same fashion as some fiber reactive dyes are previnylized, by treating it with alkali at a pH of about 9.0 to about 9.5 until the pH is stabilized. Preferably, the previnylization step is carried out at a temperature of up to about 190° F. After previnylization, acid is added to reduce the pH of the dyebath. Any acid may suffice for this purpose, but sulfamic and sulfuric acids are preferred. Sufficient acid should be added to reduce the pH of the dyebath to between about 0.5 and about 6.5 for application to medium and deep dye nylons, and between about 0.5 and about 1.5 for application to cationic and light dye nylons. Anionic leveling agents, non-ionic wetting agents, defoamers, thickeners (for space or continuous dyeing) and other additives known to those having ordinary skill in the art to which the invention relates may also be added to the dyebath. For batch procedures, the temperature of the dyebath should be elevated to at least 160° F. for application to the nylon fiber. For space and continuous dyeing, the nylon fiber to which the dyebath has been applied should be steamed at or above 210° F. for at least about one minute. After heat fixation, the nylon must be treated in an alkaline bath in order to effect covalent bonding between the fiber reactive dyes and the fiber and between the modified protective entity and the fiber. Any alkali might suffice for this purpose, but trisodium phosphate or an alkali metal carbonate are preferred. Further heat setting by any conventional method may be necessary for some space dyeing applications to assure fixation of the covalently bonded protective entity.

If the modified protective entity is applied to nylon fibers in a dyebath along with acid, acid premetalized or disperse dyes, the modified protective entity may be applied in the dyebath without fear of interference with the ionic bonding or solid absorption mechanisms by which such dyes attach to the nylon. In use with acid, acid premetalized or disperse dyes, the modified protective entity should be added to the dissolved dyes before the final dyebath pH is adjusted. The dyes and the modified protective entity may then be simultaneously applied to the nylon at a dyeing pH ranging from about 0.5 to about 6.5. After dyeing is complete, the nylon must be subjected to a brief alkali treatment to effect covalent bonding between the modified protective entity and the amine groups (or other functional groups) in the nylon. Any alkali may suffice for this purpose, and trisodium phosphate is one of the preferred ones.

After application of the modified protective entity to nylon fibers and subsequent treatment with an alkali as described herein, the covalently bonded protective entity should be permanently-substantive to any wear or wet treatment which may be applied to the final product, including washing, overdyeing, spillage, abrasion and steam cleaning.

The following examples are illustrative of the invention and either illustrate actual practices (Examples 1 and 2) that have been carried out, or a practice (Example 3) that the inventors believe could be carried out according to the invention.

EXAMPLE 1

A 100 lb. Sample of Solutia MET light dye nylon was knitted into a tubing and dyed in a jet dye machine with 0.2% Reactive Blue 19, a bifunctional fiber reactive dye containing at least one vinyl sulfone reactive group. A 5.0% quantity of an unmodified formaldehyde condensate of 2-amino-naphtholsulfonic acid, a conventional stain blocker, was previnylized and added along with the dyestuff. The pH of the dyebath was set at 1.0 with sulfamic acid. The temperature of the dyebath was raised to 212° F. and the nylon was dyed for 45 minutes. After rinsing, a quantity of 10% owf trisodium phosphate was applied to the nylon at 140° F. for 15 minutes. The nylon was removed from the jet and dried continuously at 325° F. A sample of the blue dyed nylon was subsequently exposed to a 24 hour Kool Aid stain test. The tested sample showed only a light stain from the cherry Kool Aid. Another sample of the same dyed nylon was washed five times at 160° F. with a mild laundry detergent, rinsed well and dried. This sample was also exposed to the 24 hour Kool Aid stain test, and showed a significant stain indicating that at least a substantial portion of the 2-amino-naphtholsulfonic acid stain blocker has been washed out.

EXAMPLE 2

A quantity of a formaldehyde condensate of 2-amino-naphtholsulfonic acid was reacted with a sulfato-ethyl sulfone to form a modified protective entity (stainblocker) with the following structure:

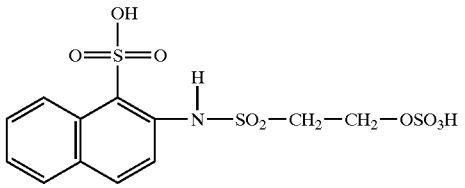

The method of Example 1 was repeated except that this modified protective entity was substituted for the unmodified 2-amino-naphtholsulfonic acid. The modified stainblocker appeared to form covalent bonds with the nylon fiber without interfering with the bonding occurring between the Reactive Blue 19 and the fiber. The light blue yarn obtained from this dyeing showed the same initial stainblocking properties as the yarn in Example 1. However, after five washings, this sample did not stain any worse than prior to washing, indicating that covalent bonding had occurred and that the stainblocker had become permanently attached to the nylon fiber.

EXAMPLE 3

A dyebath may be prepared containing 1.0 g/l anionic leveling agent 2.0 g/l non-ionic wetting agent 0.3 g/l Acid Yellow 151

0.5 g/l formic acid

This dyebath may be uniformly applied to a carpet sample tufted from 1360 denier Solutia KET medium dyeable nylon at a 400% wet pick-up. The sample may be steamed for 6 minutes, washed and dried.

A second sample may be run by the same procedure except that 25 g/l of the modified protective stainblocker described in Example 2 may be previnylized and added to the dyebath. After steaming, this second sample may be exposed to a rinse containing 20 g/l of TSP for 20 seconds before washing and drying.

If the two yellow dyed samples are subjected to the 24 hour Kool Aid stain test, it is anticipated that the first sample will exhibit a heavy red stain whereas the second sample will show only a very light stain. If a section of the second sample is then steam cleaned ten times and exposed to the 24 hour Kool Aid stain test, it is anticipated that the sample will show only a very light stain that is no worse than the stain exhibited before steam cleaning.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A method for treating nylon fibers, which method comprises:

(a) reacting a protective entity with a moiety having the capability of forming a covalent bond with a nylon fiber to create a modified protective entity that is adapted to form a covalent bond with a nylon fiber;

(b) adding the modified protective entity to a dyebath containing one or more dyes selected from the group consisting of fiber reactive dyes, acid dyes, acid-premetalized dyes and disperse dyes;

(c) applying the dyebath to nylon fiber at a pH within the range of about 0.5 to about 6.5;

(d) applying an alkali solution to the fiber.

2. The method of claim 1 which includes treating the modified protective entity with an alkali solution at a pH of about 9.5 so as to previnylize said modified protective entity prior to its addition to the dyebath.

3. The method of claim 1 wherein the protective entity is selected from the group consisting of stain-blockers, chlorine resist agents and anti-oxidants, fire retardants and flammability protectors, ultraviolet radiation absorbers and other lightfastness protectors, antimicrobial and anti-bacterial agents, gas/fume fade protectors, mildew protectors, anti-stats and soil resist agents.

4. The method of claim 1 wherein the protective entity contains an alkyl or aryl structure with an available amino, carboxyl, hydroxyl or halogen group capable of forming a nucleophilic substitution or addition reaction with a moiety capable of forming a covalent bond with nylon.

5. The method of claim 1 wherein the moiety capable of forming a covalent bond with nylon is a vinyl sulfone ester.

6. The method of claim 1 wherein the moiety capable of forming a covalent bond with nylon is a chlorotriazine.

7. The method of claim 1 wherein a protective entity comprising a formaldehyde condensate of 2-amino-naphtholsulfonic acid is reacted with a sulfato-ethyl sulfone to form a modified protective entity with the following structure:

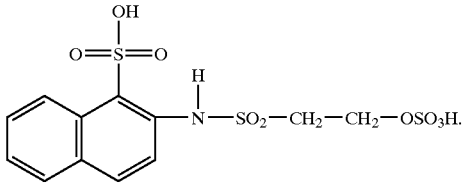

8. The method of claim 1 wherein the nylon fibers may be selected from the group consisting of deep dye nylon fibers, regular dye nylon fibers, light dye nylon fibers, cationic dyeable nylon fibers and combinations, mixtures and blends thereof.

* * * * *